US005979679A

United States Patent [19]

Ring et al.

[11] Patent Number: 5,979,679

[45] Date of Patent: Nov. 9, 1999

[54] METHOD FOR INSTALLING A LOCKING WEDGE AND CARRIER PLATE ASSEMBLY

[75] Inventors: Michael E. Ring, Crown Point, Ind.; David W. Daugherty, Jr., Plainfield; Scott Natschke, Kankakee, both of Ill.

[73] Assignee: Westinghouse Air Brake Company, Wilmerding, Pa.

[21] Appl. No.: 09/049,519

[22] Filed: Mar. 27, 1998

[51] Int. Cl.[6] ..... B61G 7/00

[52] U.S. Cl. ..... 213/50; 213/56; 29/428; 29/468

[58] Field of Search ..... 213/50, 51, 56, 213/57, 58, 61; 29/428, 464, 466, 468, 469, 505, 506

[56] References Cited

U.S. PATENT DOCUMENTS

| | | | |
|---|---|---|---|
| 4,531,648 | 7/1985 | Paton | 213/50 |
| 4,700,853 | 10/1987 | Altherr et al. | 213/60 |
| 5,000,330 | 3/1991 | Kaim et al. | 213/61 |
| 5,201,827 | 4/1993 | Glover et al. | 213/56 |
| 5,207,718 | 5/1993 | Glover et al. | 213/56 |
| 5,312,007 | 5/1994 | Kaufhold et al. | 213/50 |
| 5,520,294 | 5/1996 | Hanes | 213/61 |
| 5,598,937 | 2/1997 | Clark | 213/62 R |

*Primary Examiner*—Mark T. Le
*Attorney, Agent, or Firm*—James Ray & Associates

[57] ABSTRACT

A method of preassembling a slackless type drawbar assembly prior to installation into an end portion of a center sill member secured to a railway freight car. The method comprising the steps of providing a carrier plate member having a means for securing such carrier plate member to a flange portion of such center sill member. Securing a pair of radially opposed and axially aligned shaft support members to a top surface of the carrier plate member. Positioning a drawbar assembly on top of the shaft support members and securing in place. Positioning at least one crushable wedge support member on the top surface of such carrier plate member adjacent the shaft support members. Setting a pair of radially opposed locking wedge members on such at least one crushable support member. Securing the locking wedge members to such at least one crushable support member and the carrier plate member without distorting such at least one crushable support member. Then, positioning this assembly into such end portion of such center sill member and securing it thereto. Thereafter, tightening the locking wedge members in place until all slack has been removed from such slackless drawbar assembly thereby at least one of crushing and flattening the crushable support member.

17 Claims, 5 Drawing Sheets

METHOD FOR INSTALLING A LOCKING WEDGE AND CARRIER PLATE ASSEMBLY

CROSS-REFERENCE TO RELATED APPLICATIONS

This patent application is related to our co-pending patent application Ser. No. 09/049,262 entitled "A Carrier Plate For A Slackless Drawbar Assembly" and our co-pending patent application Ser. No. 09/049,553 entitled "A Locking Wedge For A Slackless Drawbar Assembly", each of which is being filed concurrently herewith. These patent applications are assigned to the Westinghouse Airbrake Company, the assignee of the present invention, and their teachings are incorporated into the present document by reference thereto.

FIELD OF THE INVENTION

The present invention relates, in general, to slackless type drawbar assemblies which are used in the railway industry to couple together the adjacently disposed ends of a pair of railway type freight cars in a substantially semi-permanent fashion and, more particularly, this invention relates to a method of installing a locking wedge member and carrier plate assembly in a slackless drawbar assembly via a crushable support member which is positioned beneath the locking wedge member so as to maintain the installation height of the locking wedge member during installation of the slackless drawbar system. This crushable support member may be crushed and/or flattened and left in place beneath the locking wedge member once installation is complete. The present invention enables prepositioning of the various components of the slackless drawbar system in place prior to tightening of the components in place.

BACKGROUND OF THE INVENTION

Slackless type drawbar assemblies have generally been well known, in the railroad industry, for several years as a viable means to connect together the adjacently disposed ends of a pair of railway freight cars, in both a substantially slack free and semi-permanent fashion, prior to the development of the present invention.

In other words, these railway freight cars typically will not require frequent separation during service. Normally, these railway freight cars will only be separated during a required repair and/or routine maintenance being performed on one or more of them.

These particular railway freight cars are normally of the type utilized in what is most commonly referred to, in the railroad industry, as dedicated service. Railway freight cars of such dedicated service type will at least include: those cars which are normally utilized to haul coal, coke and/or various other types of raw minerals, automotive type transport carriers, cars which are used in transporting various types of building materials and tank cars which are used to transport various types of liquids.

Examples of some other raw minerals transported in these dedicated service railway freight cars include: various types of ore, cement and stone. The various types of liquids that are transported by such dedicated service railway freight cars will at least include a number of different chemicals. Building materials transported in this manner include: lumber, dry wall, plywood, paneling, etc.

A typical drawbar assembly includes the following elements: a female connection member, a male connection member retained in such female connection member, a drawbar connected to such male connection member and at least one wedge member.

One of the major drawbacks of these prior art type slackless drawbar assemblies is that a method did not exist that would enable one to assemble and attach the drawbar assembly unit as a whole to the carrier plate prior to the installation of such slackless drawbar unit into the center sill portion of a railway freight car. In other words, each component had to be installed as an individual part. This required a significant amount of time and effort to insure that the individual components were in proper position and alignment prior to use. The present invention provides for a method to overcome this problem associated with the prior art method of installing a slackless drawbar assembly.

SUMMARY OF THE INVENTION

The present invention provides a method of preassembling a slackless type drawbar assembly prior to installation into an end portion of a center sill member secured to a railway freight car. Such method includes the steps of providing a carrier plate member having a means for securing the carrier plate member to a flange portion of such center sill member. Securing a pair of radially opposed and axially aligned shaft support members to a top surface of such carrier plate member at a first predetermined location. Thereafter, positioning the drawbar assembly on top of such shaft support members and securing it in place. Positioning at least one crushable wedge support member on such top surface of the carrier plate member, at a second predetermined location, adjacent such shaft support members. Then, setting a pair of radially opposed locking wedge members on a top surface of such at least one crushable support member. Thereafter, securing such locking wedge members to the at least one crushable support member and to such carrier plate member without distorting the at least one crushable support member. Next, positioning this assembly into such end portion of such center sill member and securing it thereto and then tightening such locking wedge members in place until all slack has been removed from the slackless drawbar assembly thereby at least one of crushing and/or flattening such crushable support member.

OBJECTS OF THE INVENTION

It is, therefore, one of the primary objects of the present invention to provide a method for preassembling a slackless type drawbar assembly prior to installation into an end portion of a center sill member secured to a railway freight car.

Another object of the present invention is to provide a method of maintaining the height of a locking wedge member above a carrier plate member during assembly and installation of the slackless drawbar system.

Yet another object of the present invention is to provide a method for maintaining the height of a locking wedge member during installation of the slackless drawbar system which will prevent shifting of the locking wedge member during such installation.

Still yet another object of the present invention is to provide a method for maintaining the height of a locking wedge member during assembly and installation of the slackless drawbar system which is relatively simple to use.

An additional object of the present invention is to provide a method for retrofitting an existing center sill equipped to accept a standard coupling mechanism such that it will accept a slackless type drawbar assembly.

In addition to the various objects and advantages of the present invention which have been discussed in some detail above, various other objects and advantages of the invention will become more readily apparent to those persons who are skilled in the relevant art from the following more detailed description of the invention, particularly, when such description is taken in conjunction with the attached drawing Figures and the appended claims.

Figure 1:
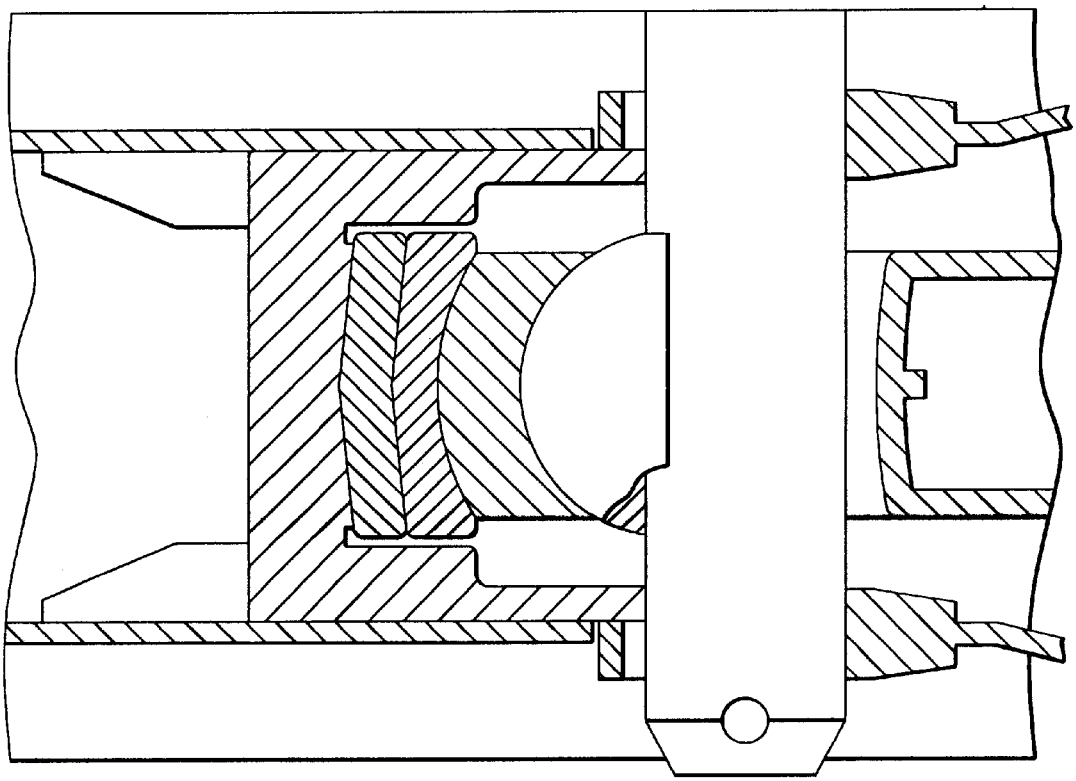
FIG. 1 PRIOR ART
FIG. 1 illustrates a slackless type drawbar assembly according to the prior art.

BRIEF DESCRIPTION OF THE PRESENTLY PREFERRED AND VARIOUS ALTERNATIVE EMBODIMENTS OF THE INVENTION

Prior to proceeding to the more detailed description of the present invention it should be noted that identical components, having identical functions, have been identified with identical reference numerals throughout the several views illustrated in the attached drawing Figures for the sake of clarity and understanding the invention.

Reference is now made, more particularly, to the drawings in which FIG. 1 shows the drawbar system of the prior art and has been discussed above in detail.

Figure 2:
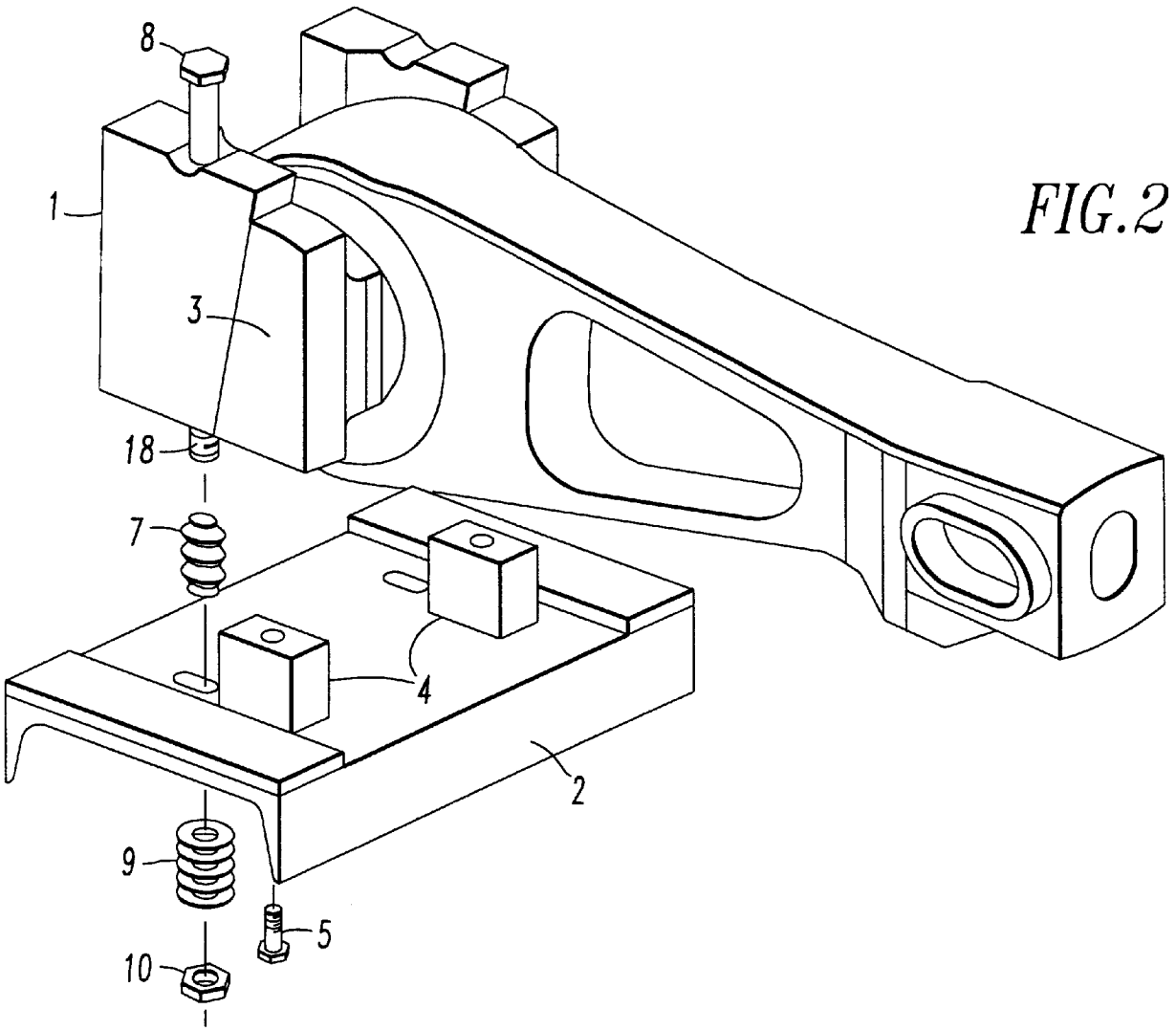
FIG. 2 illustrates an exploded perspective view of the locking wedge member and carrier plate portion of a slackless type drawbar assembly utilizing one presently preferred embodiment of the crushable support member according to the present invention.

Referring now to FIG. 2 which shows a presently preferred embodiment of a slackless drawbar assembly, generally designated 6, having a crushable support member 7 for use in the method of the present invention. The slackless drawbar assembly 6 includes a locking wedge member 1, a carrier plate 2, a pair of shafts 3, a pair of shaft support members 4, a shaft support anchoring means 5, a main drawbar portion and a male connection portion of the slackless drawbar assembly 6.

Note that this male connection portion of the slackless drawbar assembly 6 is designed so that it mates with a female connection portion of a slackless drawbar assembly, this slackless drawbar assembly being positioned on an adjacently disposed end of a railway freight car so that connection of the railway cars may be achieved. The slackless drawbar assembly 6 also includes at least one crushable support member 7, of the present invention, which is positioned above the carrier plate 2 and engageable therewith.

This crushable support member 7, preferably, has an aperture therein and an anchoring means, or bolt 8, extends through this aperture. The anchoring means 8 is engageable with the carrier plate 2 and also includes at least one threaded portion 18 for receiving a nut 10 thereon to enable tightening of the carrier plate 2 in place in the slackless drawbar assembly.

FIG. 2 also shows the placement of belleville springs 9 between the nut 10 and the bottom surface of the carrier plate 2. The locking wedge member 1 is assembled with the carrier plate 2 aligning the crushable support members 7 over the slots disposed in the carrier plate 2.

The locking wedge member 1 is positioned on the top of the crushable support member 7 such that an aperture in the locking wedge member 1, the crushable support member 7 and a corresponding slot formed in the carrier plate 2 are in alignment. The anchoring means 8 is then installed through the aperture formed in the locking wedge member 1, through the crushable support member 7 and through the slot of the carrier plate 2. Belleville springs 9 are then placed beneath the carrier plate 2 and a locknut 10 is applied onto the anchoring means 8. The nut 10 is tightened just enough to hold the locking wedge member 1 in place without distorting the crushable support member 7.

Figure 3:
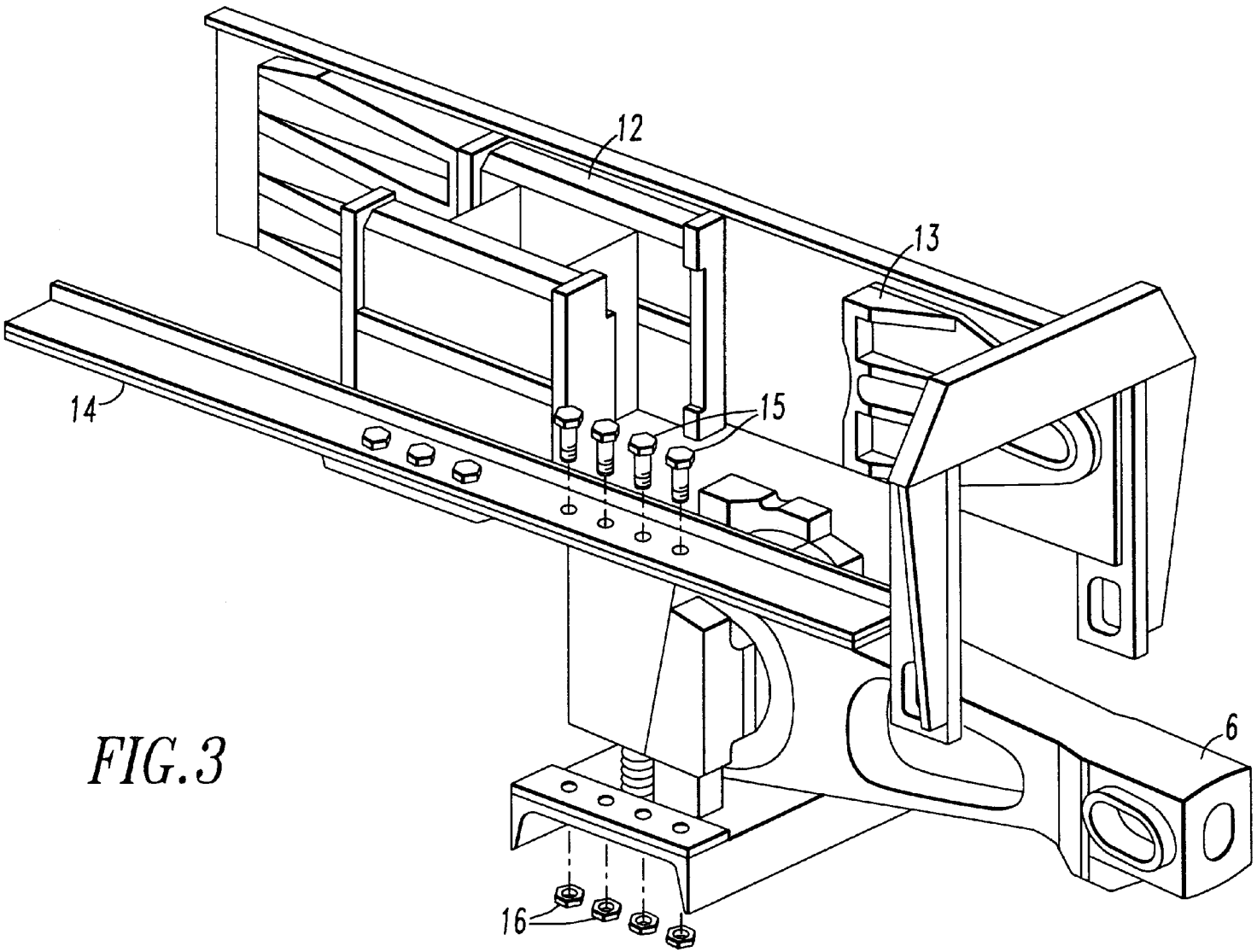
FIG. 3 illustrates an exploded perspective view of the presently preferred embodiment of the locking wedge member/carrier plate assembly being positioned within the drawbar pocket in the center sill portion of a freight car.

Once the nut 10 has been tightened, so as to hold the locking wedge member 1 in place, this entire assembly may then be raised into the drawbar pocket while aligning the holes in the carrier plate 2 assembly with holes in a center sill flange 14, as depicted in FIG. 3. The slackless drawbar system 6 is anchored in place via anchoring means 15 and locknuts 16.

The crushable support member 7 maintains the desired installation height of the locking wedge member 1 with respect to the carrier plate 2 during installation of the slackless drawbar system 6. Once the main drawbar portion, carrier plate 2 and locking wedge member 1 are installed into the car center sill, the carrier plate 2 is anchored, or bolted, to the flanges 14 of the car center sill.

Figure 4:
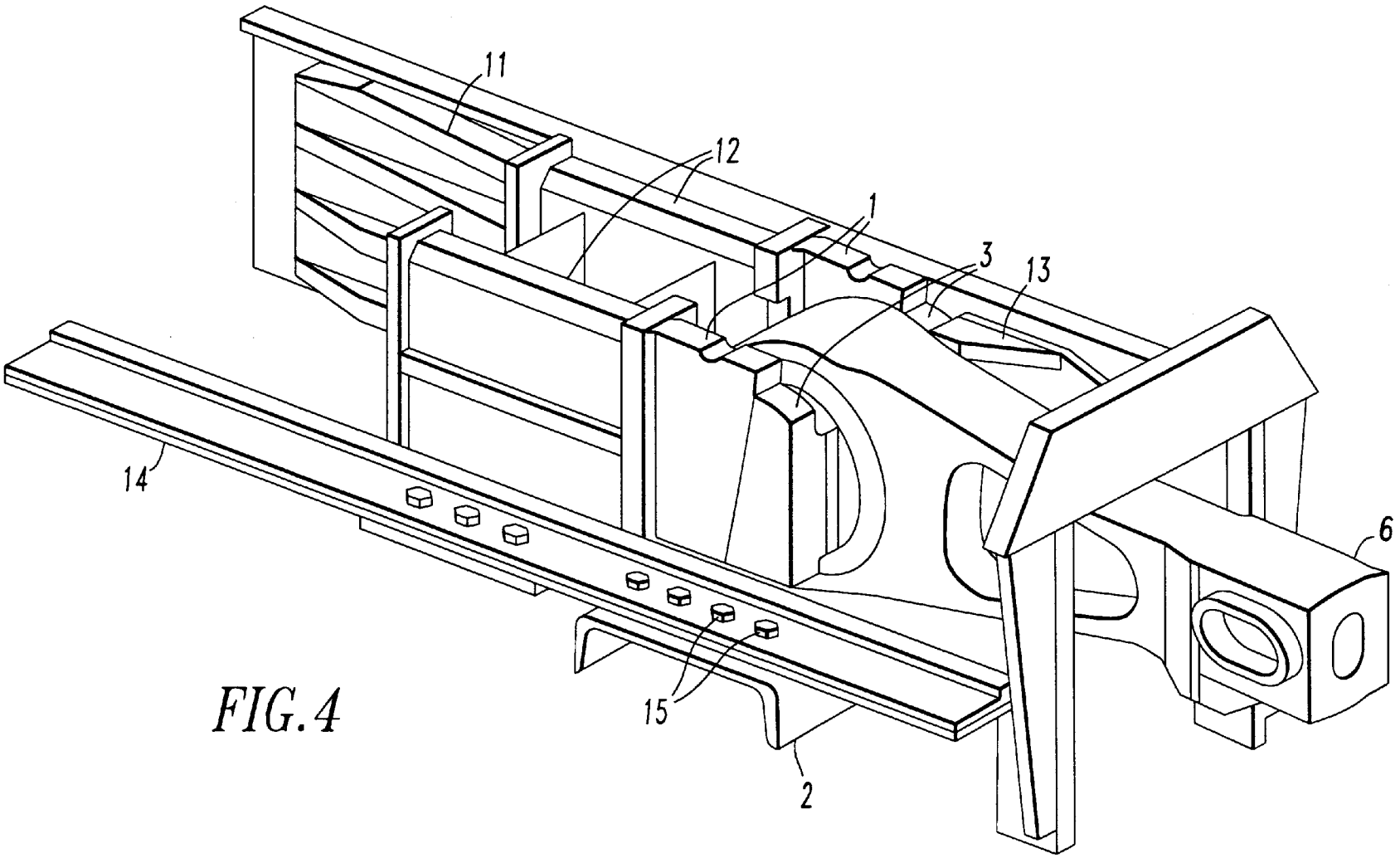
FIG. 4 illustrates a perspective view of the assembled slackless type drawbar system illustrated in FIG. 3.

The anchoring means 8 positioned through the locking wedge member 1 is then drawn tight with the nut 10 thereby drawing the locking wedge member 1 down to remove the slack that exists between all of the components between the front and rear draft lugs of a standard draft gear pocket, or a custom designed pocket. During this operation, the crushable support member 7 is crushed and/or flattened between the bottom of the locking wedge member 1 and the top of the carrier plate 2. The crushable support member 7 is then left in place beneath the locking wedge member 1 when installation is complete. Although the invention has been described as using a single locking wedge member 1, a typical slackless drawbar system 6 would typically include at least two wedges, one positioned on either side of the main drawbar portion. FIG. 4 shows the slackless drawbar system 6 in an assembled condition.

Figure 5:
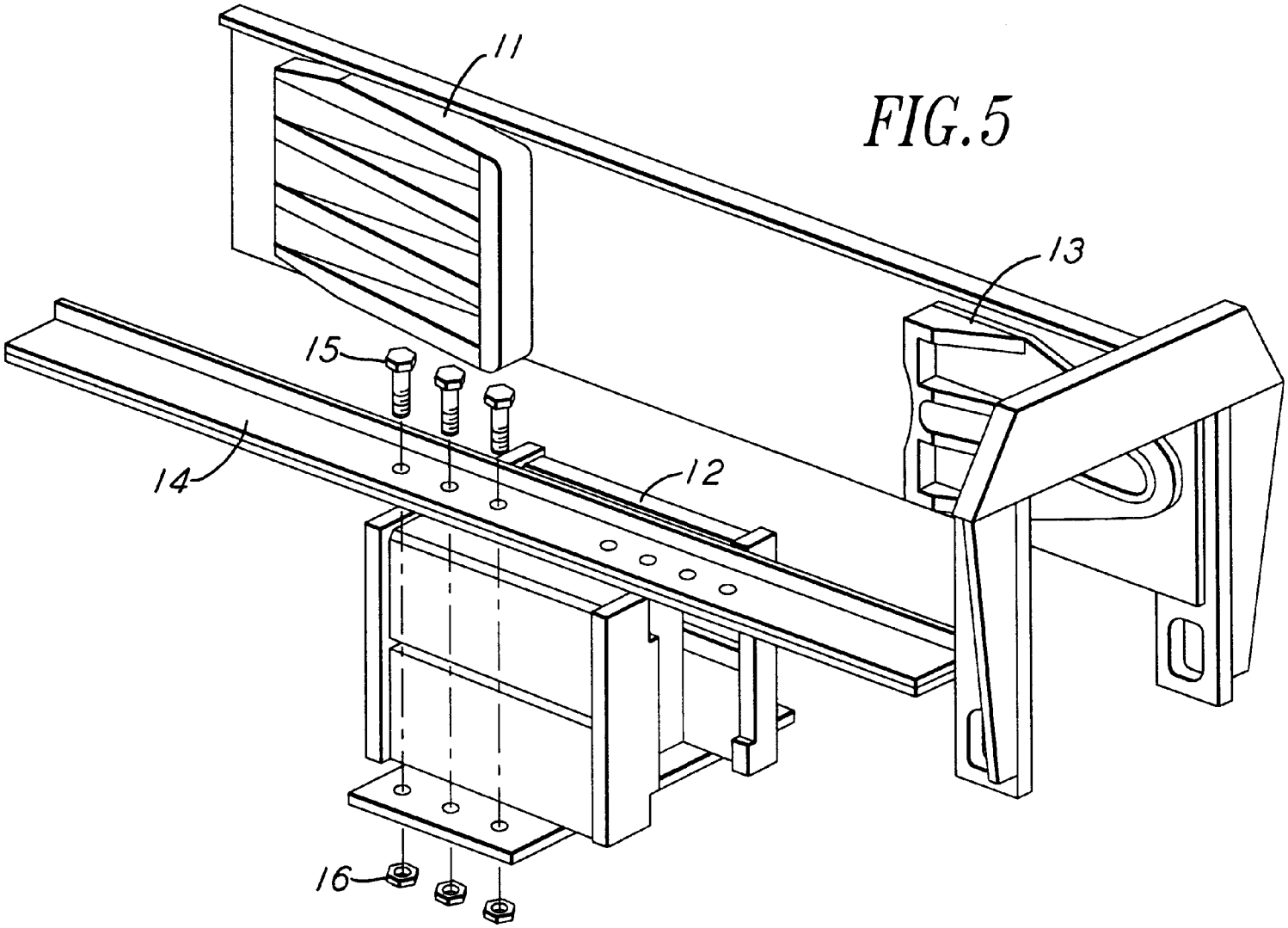
FIG. 5 illustrates an exploded perspective view of a mechanism useful for retrofitting a standard coupling arrangement for a railway car with the slackless type drawbar system illustrated in FIGS. 3 and 4.

FIG. 5 illustrates a perspective view of a filler block 12 to enable a slackless drawbar assembly to be retrofitted into the end portion of a center sill of a railway freight car. As seen in FIG. 5, the slackless drawbar assembly includes the front draft stop 13, the rear draft stop 11 and the filler block 12 which will abut against the locking wedge member (not shown in FIG. 5). The filler block 12 is provided only in systems wherein existing drawbar assemblies have been converted to the slackless type systems. This filler block 12 is provided to fill in the space between the rear draft stop 11 and the locking wedge member so as to achieve a tight fit along the length of the assembly. Newly manufactured railway freight cars designed to use slackless drawbar assemblies do not require a filler block because these assemblies are constructed so that the rear draft stop 11 is butted up against the locking wedge member.

Note that FIGS. 2–4 show the anchoring means extending through both the locking wedge member 1 and the carrier plate 2 and the tightening nut 10 being applied beneath the carrier plate 2. This showing is not intended to limit the invention to only this type of attachment of the anchoring means to the locking wedge member 1 and/or carrier plate 2. Also, it is not intended that this invention be limited to this particular location of the tightening means with respect to the locking wedge member 1.

Several different embodiments showing the attachment of the anchoring means to the locking wedge member 1 and to the carrier plate 2 and the location of the tightening nut 10 with respect to the locking wedge member 1 are taught and claimed in our co-pending application, entitled "A Locking Wedge Assembly For A Slackless Drawbar Assembly" and assigned Ser. No. 09/049,553, which is being filed concurrently herewith and the teachings of which are incorporated into the present document by reference thereto.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A method of preassembling a slackless type drawbar assembly prior to installation into an end portion of a center sill member secured to a railway freight car, said method comprising the steps of:

(a) providing a carrier plate member having a means for securing said carrier plate member to a flange portion of such center sill member;

(b) securing a pair of radially opposed and axially aligned shaft support members to a top surface of said carrier plate member;

(c) positioning a drawbar assembly on top of said shaft support members and securing in place;

(d) positioning at least one crushable wedge support member on said top surface of said carrier plate member adjacent said shaft support members;

(e) setting a pair of radially opposed locking wedge members on said at least one crushable support member;

(f) securing said locking wedge members to said at least one crushable support member and said carrier plate member without distorting said at least one crushable support member;

(g) positioning this assembly into such end portion of such center sill member and securing thereto; and (h) tightening said locking wedge members in place until all slack has been removed from said slackless drawbar assembly thereby at least one of crushing and flattening said crushable support member.

2. A method of installing a slackless drawbar assembly as recited in claim 1 wherein said slackless drawbar assembly is secured to said end portion of said center sill, in step (g), by bolting.

3. A method of installing a slackless drawbar assembly as recited in claim 2 wherein said pair of radially opposed and axially aligned shaft support members are secured to said top surface of said carrier plate member, in step (b), by bolting.

4. A method of installing a slackless drawbar assembly as recited in claim 3 wherein said drawbar assembly is secured to said shaft support members, in step (c), by bolts used to secure said shaft support members to said carrier plate member.

5. A method of installing a slackless drawbar assembly as recited in claim 4 wherein said method includes an additional step of providing an aperture in said locking wedge members, said aperture having a first predetermined length, and positioning an anchoring means in said aperture such that a threaded portion of said anchoring means extends at least one of through said aperture in said locking wedge members and into said aperture for a second predetermined length to secure said locking wedge members, in step (f), to said at least one crushable support member and said carrier plate member without distorting said at least one crushable support member.

6. A method of installing a slackless drawbar assembly as recited in claim 5 wherein said first predetermined length extends from a top surface to a bottom surface of a locking wedge members.

7. A method of installing a slackless drawbar assembly as recited in claim 5 wherein said second predetermined length is less than said first predetermined length.

8. A method of installing a slackless drawbar assembly as recited in claim 5 wherein said aperture extends partially upward through a bottom surface of said locking wedge members and at least said threaded portion of said anchoring means is positioned within said aperture.

9. A method of installing a slackless drawbar assembly as recited in claim 1 wherein said method includes an additional step of leaving said at least one crushable support member in place after said tightening of said locking wedge members, in step (h), until substantially all slack has been removed from said slackless drawbar assembly.

10. A method of installing a slackless drawbar assembly as recited in claim 9 wherein said method includes an additional step of positioning a pair of radially opposed and axially aligned crushable wedge support members on said top surface of said carrier plate member adjacent said shaft support members.

11. A method of installing a slackless drawbar assembly as recited in claim 1 wherein said method includes an additional step of replacing a standard coupling mechanism by retrofitting an existing railway freight car to accept said slackless drawbar assembly in said center sill member.

12. A method of installing a slackless drawbar assembly as recited in claim 11 wherein said retrofitting said existing railway freight car to accept said slackless drawbar assembly in said center sill member includes the steps of:

(a) providing a second carrier plate member having a means for securing said second carrier plate member to said flange portion of said center sill member;

(b) positioning a filler block member on said second carrier plate member with guides for said locking wedge members facing forward;

(c) raising said second carrier plate member upward until said filler block member is within said center sill member; and (d) securing said second carrier plate member to said flange portion of said center sill member.

13. A method of installing a slackless drawbar assembly as recited in claim 12 wherein said second carrier plate member is secured to said flange portion of said center sill member by one of bolting and welding.

14. A method of installing a slackless drawbar assembly as recited in claim 13 wherein said second carrier plate member is secured to said flange portion of said center sill member by bolting.

15. A method of installing a slackless drawbar assembly as recited in claim 14 wherein said at least one crushable support member is crushed when said locking wedge members are tightened in place.

16. A method of installing a slackless drawbar assembly as recited in claim 15 wherein said method includes an additional step of leaving said at least one crushable support member in place after said tightening of said locking wedge members until substantially all slack has been removed from said slackless drawbar assembly.

17. A method of installing a slackless drawbar assembly as recited in claim 16 wherein said method includes an additional step of positioning a pair of radially opposed and axially aligned crushable wedge support members on said top surface of said carrier plate member adjacent said shaft support members.

* * * * *